United States Patent [19]

Brieger

[11] Patent Number: 4,756,371

[45] Date of Patent: Jul. 12, 1988

[54] PERFORATION APPARATUS AND METHOD

[76] Inventor: Emmet F. Brieger, Bonito Rte., Nogal, N. Mex. 88341

[21] Appl. No.: 941,609

[22] Filed: Dec. 15, 1986

[51] Int. Cl.[4] ..... E21B 37/00; E21B 43/114; E21B 43/117

[52] U.S. Cl. ..... 166/312; 175/4.51; 175/4.52; 175/4.6

[58] Field of Search ..... 166/55, 55.1, 297, 298, 166/189, 100, 312; 175/4.6, 4.55, 4.51, 4.52, 2, 67

[56] References Cited

U.S. PATENT DOCUMENTS

| | | | |
|---|---|---|---|
| 3,347,314 | 10/1967 | Schuster | 166/100 X |
| 3,447,607 | 6/1969 | Harris et al. | 166/100 X |
| 3,630,282 | 12/1971 | Lanmon | 166/100 X |
| 3,707,195 | 12/1972 | Lanmon | 166/100 X |
| 4,105,073 | 8/1978 | Brieger | 166/286 |

*Primary Examiner*—Stephen J. Novosad

[57] ABSTRACT

A perforation apparatus is coupled to a tubing string and is eccentrically positioned in a casing in a well bore by eccentering devices so that annular sealing rings along the length of the apparatus sealingly engage the casing. Shaped charge devices are arranged in pairs so that a pair of shaped charges produces, when detonated, a horizontal and an inclined perforation which intersect in the earth formations behind the casing. One of the perforations extends through a sealing ring to the interior of the perforating apparatus and one of the perforations opens to the casing. By applying differential pressure between the fluid in the casing and the inside of the tubing, for example by running the tubing dry, hydraulic jetting of fluid is produced in one perforation with a fluid return though the other perforation to the tubing string. Thus the penetrations of the shaped charge jet and the hydraulic jet are additive, and the perforation tunnel into the formation is washed free of shaped charge debris and compaction. Numerous perforations can be thus produced simultaneously. With the tool left in place during injection or production, the perforations can be reworked repeatedly by hydraulic jetting.

19 Claims, 5 Drawing Sheets

PERFORATION APPARATUS AND METHOD

FIELD OF THE INVENTION

This invention relates to perforation systems, and more particularly, to perforation systems in which shaped charge perforating devices are combined with hydraulic jetting functions for producing deep and clean perforations in earth formations.

BACKGROUND OF THE INVENTION

In oil field operations where earth formations are traversed by a casing it is customary to produce perforations at selected intervals along the casing where the perforations extend from the casing, through a surrounding cement sheath and into the earth formations. The perforations serve to place the bore of the casing and the earth formations in fluid communications for either injecting liquids into the formations or for producing fluids from the formations.

Typical completion practices for producing perforations currently utilize shaped charges. Shaped charges, when detonated, produce a perforating jet of high velocity, high energy particulate matter which penetrate a steel casing, a column of cement and earth formations to produce a perforation. While there are a number of shaped charge designs to eliminate the side effects of a perforating jet, there is no effective way to eliminate damage to the earth formations by the perforating jet or damage to the perforation. The damage includes plugging of the earth formation or the perforation by either the perforating jet or a jet slug. While some jet slugs can be caught or principally eliminated by design, the damage to the wall of the perforation cannot be eliminated.

To enhance the flow characteristics, it has been proposed to "back-flush" the perforations by a pressure differential between the formations and the casing so that the effects of the jet perforation can be flushed out of or from the earth formations. However, the effectiveness of this process is subject to adequate formation pressure and permeability.

In the prior art, efforts were made to develop perforations by a hydraulic jet of fluid using surface pumps, and this process was never widely used although it was appreciated that a high velocity fluid jet could effectively produce perforations.

Both shaped charge perforating and hydraulic perforating as currently done, have limited penetration depth into the formation from the well bore. Deeper penetration is desirable for increased well production.

SUMMARY OF THE PRESENT INVENTION

The present invention relates to perforating systems for an oil well completion operation in which a shaped charge and hydraulic perforation device is coupled to a string of tubing and is disposed in a casing adjacent to earth formations to be perforated. The tool system combines shaped charge jet perforating and hydraulic jet perforating, making the penetration of each perforation operation additive and producing washed perforation tunnels. The hydraulic jet is produced without surface pumps, by the differential pressure between the casing hydrostatic pressure and empty or partially filled tubing. The perforating device is also a production tool and includes eccentering means for positioning the tool to one side of the well casing. Along the length of the tool are longitudinally spaced, annular sealing rings where each sealing ring is intended to provide a communication path between the interior of the production tool and a perforation in the earth formations. The interior of the tool is in fluid communication with the bore of the string of tubing.

Shaped charges in the tool are arranged in pairs where a pair of shaped charge devices produces intersecting perforations in the earth formations behind the casing. One perforation extends through a sealing ring and one perforation is open to the bore of the casing. By applying liquid under pressure in the casing, a hydraulic jet is produced in the one perforation with access to the casing and the fluid jet is provided a return path though the other perforation and sealing ring so that a continuous and sustained fluid jetting operation can be accomplished. The effect of the fluid jet operation is to clean the perforations produced by the shaped charges and to deepen the perforations by the hydraulic jetting operation.

Surface equipment includes pumps and reservoirs for handling fluid input and egress of fluid from and to the string of tubing and the well casing. Coiled tubing can also be used to establish pressure differentials in the string of tubing as necessary for operations. Pressure control can also be obtained by use of a pressure actuated valve in the tubing string.

DESCRIPTION OF THE INVENTION

Figure 1:
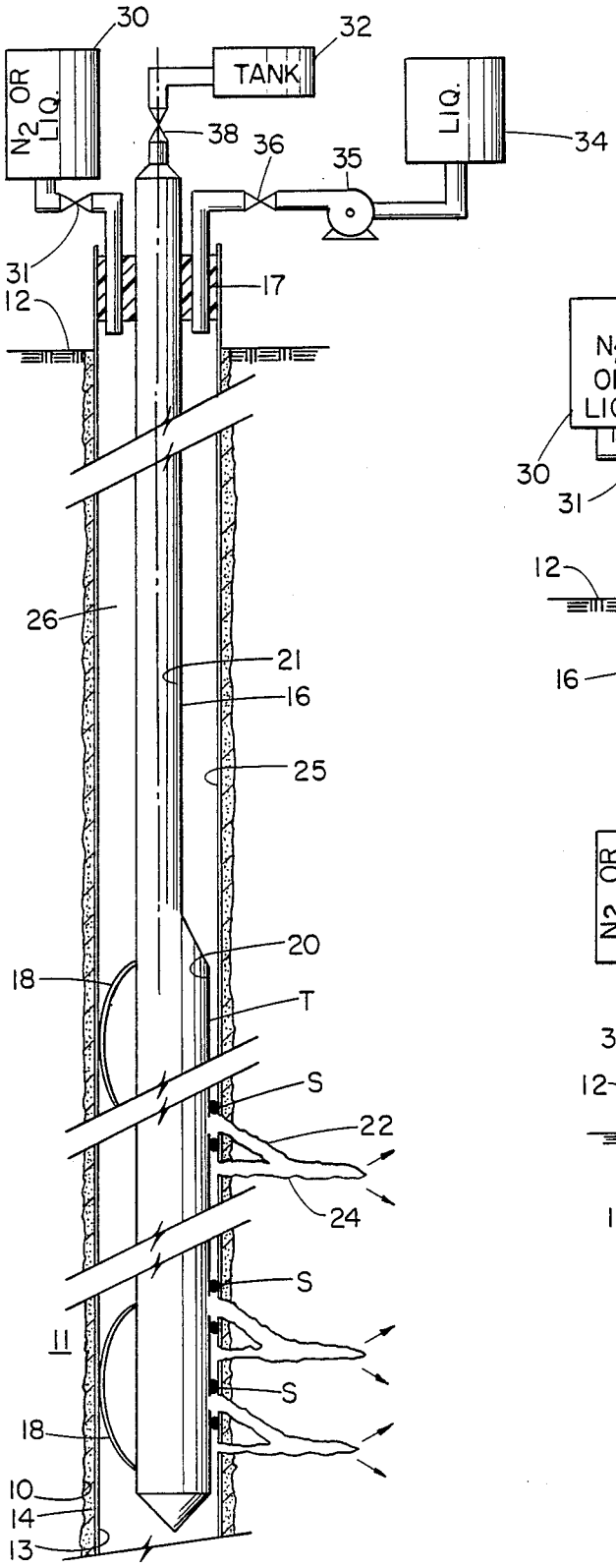
FIG. 1 illustrates schematically a system for performing a method of the present invention.

Referring now to FIG. 1, well apparatus for practicing the present invention is illustrated. In FIG. 1, a well bore or borehole 10 traverses earth formations 11 and extends from the earths ground surface 12 to a production level where perforations are desired in the earth formations. The well bore 10 is lined with a casing or liner 13 which is cemented in place in the borehole so that an annulus of cement 14 is disposed between the casing 13 and the borehole 10. A string of tubing or pipe 16 extends from a conventional well head 17 at the earths surface to a production tool T at the production level. The production tool T is eccentrically positioned to one side of the casing 13 by eccentering means 18 such as bow springs or drag blocks. The production tool T has external, longitudinally spaced, annular sealing rings S disposed along its length where each sealing ring S is intended to seal the tool T with respect to the casing 13 and to provide a communication path between an opening in the production tool T and an opening in the casing 13. The opening in the sealing ring of the production tool T communicates with an internal passageway 20 in the interior of the production tool T to the bore 21 of the string of tubing 16. The opening in the sealing ring on the casing communicates with an angular perforation 22 which extends through the annulus of cement 14 and into the earth formations 11. The angular perforation 22 in the earth formations intersects a horizontal perforation 24 which extends in a horizontal direction (or a direction perpendicular to the length of a casing) from an opening in the casing. The opening in the casing is in fluid communication with the fluid or liquid in the bore 25 of the casing. Hereinafter, an explanation will be made as to the apparatus for producing the intersecting horizontal and angular perforations 22, 24 and such apparatus includes shaped charge perforating devices.

At the earth's surface 12, an open reservoir 30 containing a fluid or liquid is coupled by a control valve 31 and the well head 17 to the bore 25 of the casing and to the annulus 26 between the casing 13 and the string of tubing 16. Alternatively, the reservoir 30 can be a closed vessel containing nitrogen under pressure. The purpose of the reservoir 30 is to replenish the fluid in bore 25 and alternately to supply pressure to fluid or liquid in the bore 25 of the casing 13. A second reservoir 34 is connected by a pump 35, a valve 36 and the well head 17 to the bore 25 of the casing and to the annulus 26 between the casing 13 and the string of tubing 16. The tubing 16 extends through the well head 17 and is connected above the well head 17 by a valve 38 to a return reservoir 32.

According to a first method for application in water injection wells, the production tool T and string of tubing 16 are run in or lowered to locate the production tool T at the desired production level. While lowering in the production tool T to the production level, the bore of the string of tubing 16 can be empty, filled, or partially filled with liquid. The effect of liquid in the bore of the tubing 16 is to establish a hydrostatic pressure in the tubing at the production tool. When the production tool T is properly located and the surface well head and surface equipment shown in FIG. 1 are connected. The perforations 22 and 24 are next produced. Next, liquid or fluid under pressure in the bore 25 of the casing is forced into a perforation 24 and forced out through an intersecting perforation 22 into the production tool T and into the string of tubing 16. The liquid or fluid should be a jetting fluid such as water, mud, oil, sand laden water, mud, or oil or other abrasive laden fluids such as acids. The force and/or velocity of the fluid flow in the perforation 24 is a function of the pressure in the casing and the pressure in the string of tubing 16. The force of the liquid in the horizontal perforation 24 produces a hydraulic jetting effect which increases the depth of the perforation produced by a shaped charge. Additionally, the depth of the perforation extending beyond the initial depth of penetration produced by a shaped charge is "clean" formation which is unaffected by the shaped charge. Liquid or fluid under pressure is applied to the perforation for as long as desired to enable production of the desired depth of the perforation 24. Where the fluids contain particles such as sand, the fluids are circulated out of the well without the sand settling out as in conventional operations.

The foregoing steps may be described in detail as follows: When the production tool is properly located, the well head 17 and surface equipment is connected up to the casing and to the tubing. Next the steps are:

(1) Open the valves 31 and 38, close the valve 36;

(2) Operate the shaped charges to produce the angular and the horizontal perforations 22 and 24;

(3) After the perforations 22 and 24 are produced, the formation tool T is used for passing fluid under jetting pressure into the earth formations for forming a deeper penetration 24 by hydraulic jetting, this jetting pressure can be established in four ways:

(a) by the differential pressure between the natural hydrostatic pressure inside the casing, and the lower pressure inside the empty or partially filled tubing;

(b) same as step (a), except the differential increased by adding nitrogen pressure to the casing at the surface;

(c) by applying surface pump pressure to the casing with a fluid filled tubing;

(d) steps (a) or (b), then followed by (c).

(4) After forming the perforation 24, injection of fluid into the earth formations, for example, in a water flood operation can be accomplished. For injecting water, the valves 31 and 38 are closed and the injection liquid or water is pumped from a reservoir 34 via an open valve 36 and the pump 35 into the earth formations via the horizontal perforations 24. In this operation, the fluid cannot exit from the tubing as the valve 38 is closed;

(5) In the event the horizontal perforations 24 subsequently become plugged and it is desired to reclean the horizontal perforations 24, the prior operational step 4 is discontinued and the valves 31 and 38 are opened while the valve 36 is closed. A liquid in the tank 30 (which can be different from an injection liquid in the tank 34) is pumped into the casing to return to the surface via the perforations 22, 24 and the string of tubing 16. After re-cleaning the perforations, the injection operation (step 4) can be re-started. As can be appreciated, the injection and re-cleaning can alternately be performed as often as desired.

Figure 2:
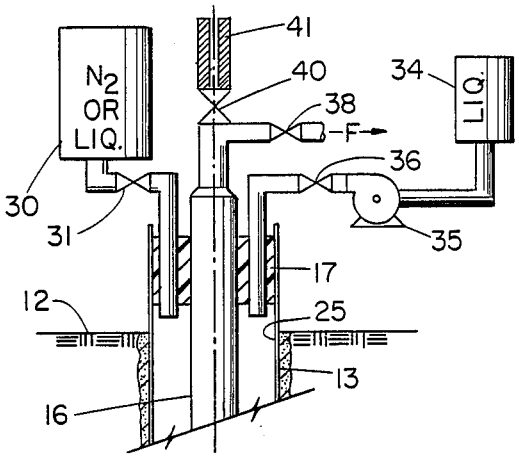
FIG. 2 illustrates a modified structure employed in a modified form of a method of the present invention.

Referring now to FIG. 2, a modified surface equipment arrangement for a method of producing and reworking a well is illustrated in which the tubing string 16 is also connected by an in line valve 40 to a conventional wireline or coiled tubing well head pressure control equipment 41. The valve 40 and control equipment 41 permit the use of other tubing tools within the string of tubing 16.

With the above equipment in place and the downhole tool T as shown in FIG. 1, as in the description of FIG.

1, steps (1), (2) and (3) are performed with the valves 31 and 38 open and the valves 36 and 40 closed. Next, the following alternative steps are performed:

(4A) The production tool T is left in the position as shown in FIG. 1; the valves 31 and 38 are closed and the valves 36 and 40 are opened. The column of fluid in the string of tubing 16 is lowered by:

(1) swabbing with a wire line cable passed through the valve 40 or;

(2) using nitrogen and a coiled tubing process with the control equipment 41; or (3) in the alternative, by closing the valves 36 and 40 and opening the valves 31 and 38 and by applying nitrogen pressure to the bore of the casing, the liquid in the string of tubing will be displaced through the valve 38.

(4B) After reducing the column of liquid in the string of tubing (step 4A), the nitrogen is bled off (if nitrogen is used). The valves 36 and 40 are closed so that fluids under formation pressure in the earth formations are produced via the perforations 22 and the string of tubing and the valve 38 to a suitable tank.

(5) In the event it is desired to rework the perforations 24, the valves 31, 38 and 40 are closed and the valve 36 is opened. The liquid in the tank 34 is pumped under pressure to the perforations 24. The valve 38 is opened so that fluid pumped into the perforations 24 is returned via the perforations 22. Following reworking, production is resumed as set forth in step 4A and 4B above.

Figure 3:
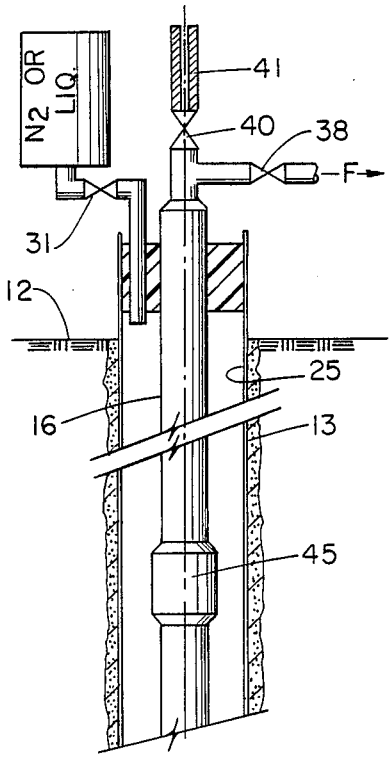
FIG. 3 illustrates still another modified structure employed in a modified form of a method of the present invention.

Referring now to FIG. 3, a system is shown for repeat hydraulic jetting without a surface pump and shown as using a downhole tubing valve. In FIG. 3, the surface equipment is similar to that of FIG. 2 except that the pump 35 and tank 34 are not used and the string of tubing 16 includes a conventional annulus pressure actuated, downhole tubing valve 45 such as a Halliburton APR® tester valve. The valve 45 is conventional and constructed so that when the pressure in the bore of the casing is higher or greater than the pressure in the bore of the string of tubing, the valve 45 opens and is held open. When the pressure in the casing and in the string of tubing are equalized, the valve 45 closes.

The method using the modified apparatus of FIG. 3 is as in steps 1, 2 and 3 described with respect to FIG. 1 to produce the perforations 22 and 24. Thereafter, hydraulic jetting can be repeated as often as desired as follows:

(4AA) The valve 31 is closed, the valves 40 and 38 are opened. The tubing valve 45 is closed because the pressure in the casing is equal to the pressure in the string of tubing. A coiled tubing (not shown) is inserted via the valve 40 to the level of the production tool. Nitrogen is then introduced via the valve 38 to the production string of tubing 16 which forces fluid in the string of tubing out of the string of tubing via the coiled tubing. This is continued until sufficient fluid is removed from the tubing. Equalized pressure between tubing and casing are maintained with the nitrogen. The coiled tubing is removed, the valve 40 is closed, valve 31 opened, and the nitrogen pressure is bled off via the valve 38. The tubing valve 45 opens automatically at the defined differential pressure (when the pressure in the string of tubing is less than the pressure in the casing by a defined amount) so that fluid in the casing is jetted through the perforations 24 and 22 and returned via the string of tubing.

When the pressure across the valve 45 is equalized this step can be repeated to continue the hydraulic jetting.

(5AA) To produce the well, after step 4AA, the production tool T is removed from the well. Next a string of tubing and conventional production packer are run to establish production through a string of tubing in a conventional manner.

Figure 4:
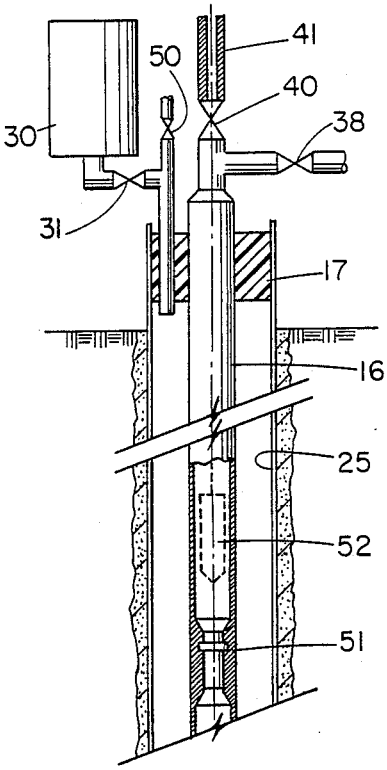
FIG. 4 illustrates still another modified structure employed in a modified form of a method of the present invention.

Referring now to FIG. 4, a modified surface equipment arrangement is illustrated for a different method where repeat hydraulic jetting is obtained by using a downhole surge tool. In FIG. 4, there is an additional valve 50 connected to the input pipe to the bore of the casing. In the string of tubing is a seating nipple or "profile" collar 51. The seating nipple 51 is adapted to accept a surge tool 52 as illustrated in U.S. Pat. No. 4,285,402.

The surge tool 52 basically provides a low pressure chamber for receiving fluid. At the start, the process is the same as steps 1, 2 and 3 described with respect to FIG. 1, with valves 31 and 38 open, the valve 40 closed and the seating nipple 51 open. This produces the perforations 22 and 24 as before. To repeat the hydraulic jetting without use of surface pumps, the valve 31 is closed and the valves 40, 38 and 50 are opened. A surge tool 52 is lowered through the string of tubing on a wireline to a location just above the seating nipple 51. Nitrogen under pressure is applied to the string of tubing 16 via the valve 38 to force the fluid out of the valve 50. Next, the surge tool 52 is seated and locked in the seating nipple 51 and the wireline removed from the tool and from the well. The valves 40 and 50 are then closed and the valve 31 opened. Next, the nitrogen pressure in the tubing above the surge tool 52 is bled off by opening the valve 38. At the pre-set differential pressure across the surge tool it will open, thus causing fluid in the casing to flow through the perforations and through the tubing and exit via the valve 38.

Figure 5:
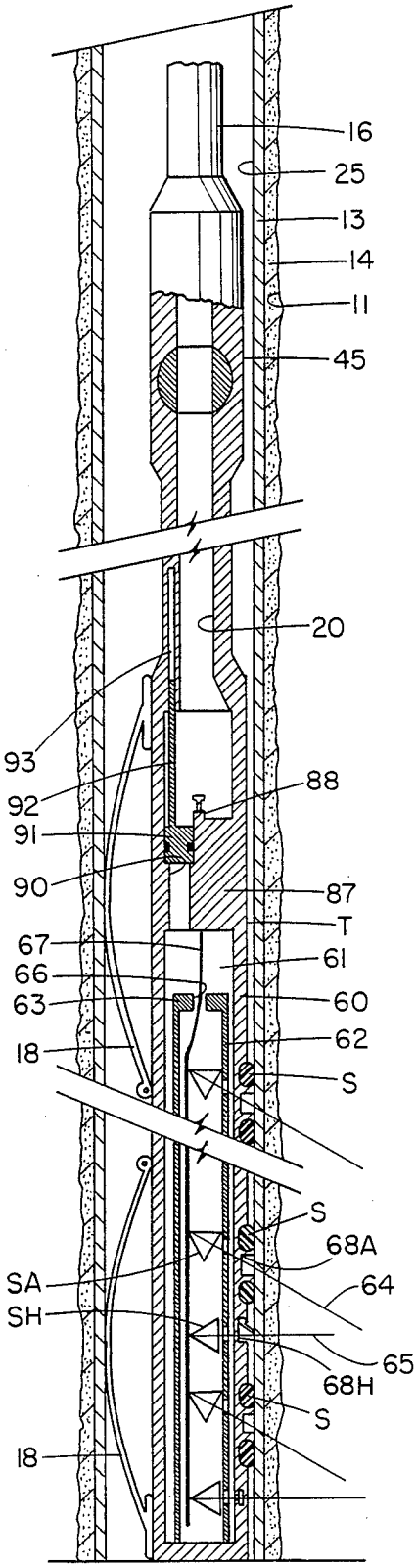
FIG. 5 schematically illustrates structure embodying the present invention.

Referring now to FIG. 5, a schematic illustration of a suitable perforation tool T is shown in a well bore 11. The well bore 11 has a casing 13 cemented in place by a column or annulus of cement 14. The perforation tool T includes an elongated steel wall member 60 having a hollow cylindrically shaped interior chamber 61. In the chamber 61 is a tubular support member 62 having an upper closed end 63. Positioned along the length of the tubular support member 62, are shaped charges $S_H$ and $S_A$ where the shaped charges $S_H$ are arranged to produce a perforating jet in a horizontal direction and the shaped charges $S_A$ are arranged to produce a perforating jet at an angle relative to a horizontal direction. The shaped charges $S_H$ and $S_A$ are arranged in pairs with a vertical spacing and radial alignment so that, when detonated, intersecting horizontal and angular perforations are formed in the earth formations behind the casing. This relationship is illustrated by the axis 64, 65. The support member has an opening at 66 to receive a primacord 67 for the shaped charges. When the shaped charges are detonated, the debris of a shaped charge housing is retained in the tubular support member 62 and prevented from entering the flow path through the tool T.

The exterior of the tool T has recesses $68_A$ and $68_H$ respectively disposed in line with an axis 64, 65 so as to provide a thin wall for a perforating jet. The recesses $68_A$ are encircled by a toroidal elastomer sealing rings S to which is adapted to engage with and seal against the wall of a well casing 25. Thus, when eccentering means 18 such as bow springs, drag blocks, or the like are employed to urge the tool T against the wall of the casing, the seals S sealingly engage the wall of the casing. Upon detonation of a shaped charge $S_A$, a perforation is produced which extends along an axis 64 through a recess, the casing wall, the column of cement and into the earth formations.

Figure 6:
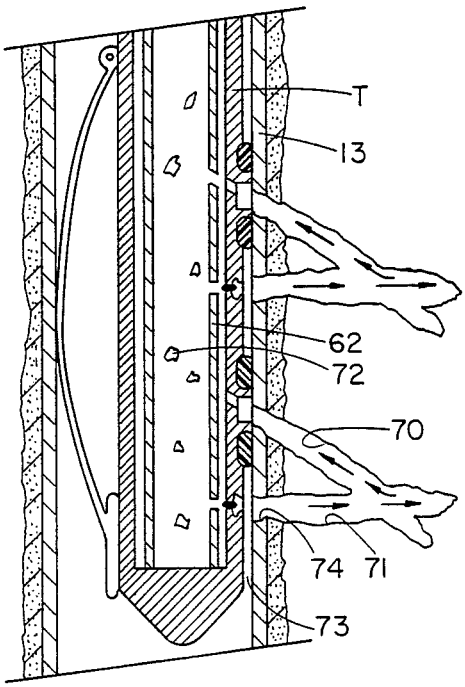
FIG. 6 schematically illustrates the effect of detonating a pair of shaped charges to produce intersecting perforations.

Referring to FIG. 6, the effect of detonating the shaped charges $S_A$ and $S_H$ is illustrated where an angular perforation 70 intersects a horizontal perforation 71. The shaped charge debris 72 is retained in the support member 62. Between the tool T and the casing 13 is a spacing 73 in which fluid in the casing can flow into or out of an opening 74 for the horizontal perforation 71.

Figure 7A:
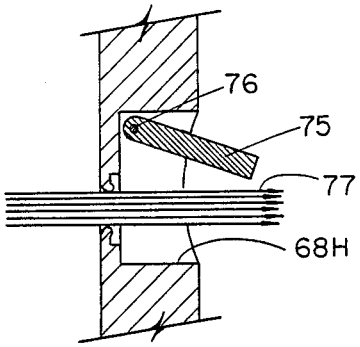
FIGS. 7*a* and 7*b* illustrate one form of closure member for a shaped charge opening.
Figure 7B:
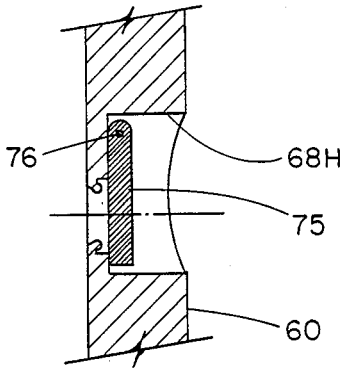

To prevent re-entry of fluid into the support member 60 through a perforation opening in a recess $68_H$ and for preventing fluid in the casing from access to the flow passageway in the support member 60, as shown in FIG. 7, the recess 68H can be provided with a flapper lid 75 which is pivotally connected to the support member 60 by a pivot pin 76. The flapper lid 75 is initially in an open position (see FIG. 7A) and when the energy of the perforating jet 77 has passed from the support member 60, the flapper lid 75 will be closed as a small amount of fluid enteres the support member 60 as shown in FIG. 7(B).

Figure 8A:
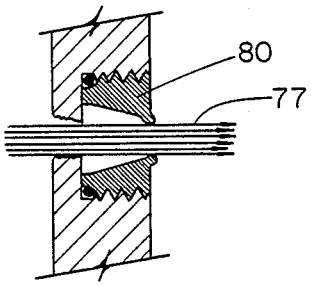
FIGS. 8*a* and 8*b* illustrate another form of closure member for a shaped charge opening.
Figure 8B:
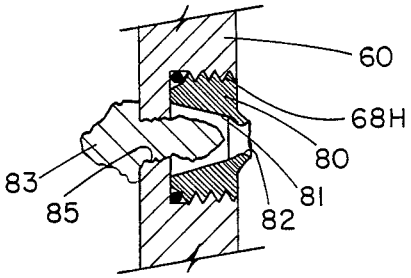

Another system for closing a perforation opening is shown in FIGS. 8A and 8B where a cap member 80 is threadedly received in the opening 68H with the cap member 80 having an internal recess 81 and a thin wall closure section 82. This conventional "carrot catcher" is perforated by a perforating jet 77 (see FIG. 8A) and the slug 83 formed in the trailing portion of the perforating jet flows into and seals the opening 85 in the support member 60. Other methods will suggest themselves to one skilled in the art. For example, each shaped charge $S_H$ can be in a separate isolated non-frangible housing.

Referring again to FIG. 5, at the upper end of the chamber 61, the primacord 67 is passed through a pressure tight bulkhead 87 to an impact or percussion firing head 88. The firing head 88 has a detonator finger which can be actuated by dropping a bar or sinker member in a conventional manner through the bore of the tubing and through the bore of a valve. The firing head could also be a pressure operated device which is conventional. Pressure operated devices are typically located at the bottom of the gun so that the bore 90 could be a larger size. The bore 20 of the tool is provided with an offset bore 90 for communicating the tubing bore 20 with the chamber 61. In the offset bore 90 is a seal member 91 with a guide rod 92 which is received in a longitudinally extending pocket 93. When the pressure in the chamber 61 below the seal member 91 exceeds the pressure in the bore 20 above the seal member 91, the offset bore 90 is opened. In the bore 20 of the tubing is the differential pressure valve 45 such as a Halliburton APR® tool. An illustration of the valve 45 may be found on pages 3465 and 3466 of Halliburton Services Sales and Service Catalog #40. The valve operates on the basis of differential pressure between the interior of the bore 20 and the casing so that for a given pressure differential the valve 45 is opened as shown and for less than a given pressure differential, the valve 45 is closed.

Figure 9:
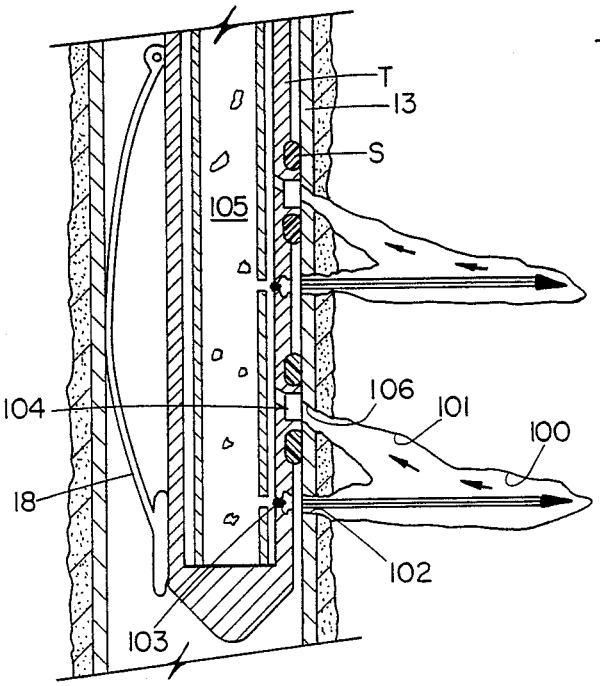
FIG. 9 schematically illustrates the effect of applying hydraulic jet operations to perforations.

Referring now to FIG. 9, there is a schematic illustration of the action of hydraulic jetting of the present invention. In FIG. 9, the perforation tool T is eccentrically disposed in a casing 13 in a cased well bore by eccentric spring means 18 so that annular seals S on the tool T sealingly engage the casing. The shaped charges are not shown, the illustration of FIG. 9 depicting events subsequent to detonation of the shape charges. The horizontal perforation 100 has produced an opening in the tool T which is plugged by a "carrot" 103 in a carrot catcher and an opening 102 in the casing has access to liquid in the casing. Another opening 104 in the tool T provides a fluid communication path from the interior 105 of the tool through a sealing ring S, through an opening 106 in the casing and through an angular perforation 101 to the horizontal perforation 100. By placing the liquid in the casing under pressure with respect to the pressure within the tool and tubing, a jet of liquid is produced through the opening 102 which impinges directly on the earth formations and produces an annular back flow of fluid and washes away particles of earth formation which are diverted through the return angular path 101 of the annular perforating jet. The flow path in the chamber 61 is between the outer diameter of the housing 62 and the inner diameter of the chamber 61.

Figure 10:
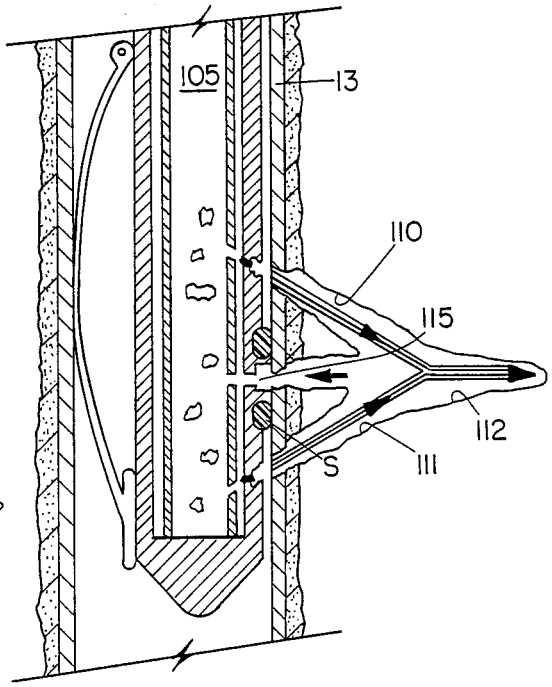
FIGS. 10 and 11 illustrates alternative configurations using more than two shaped charges in a set of charges.

Referring to FIG. 10, another form of the invention is illustrated where converging perforating jets from shaped charges produce perforations 110, 111 which intersect a horizontal perforation 112. The converging perforations 110, 111 have access to liquid in the casing 13 while the horizontal perforation 112 is in communication with the interior 105 of the Tool T. Fluid jet flow through the angular perforations 110, 111 develop a horizontal jet stream which has a return path through the center opening 115 in a sealing ring S.

Figure 11:
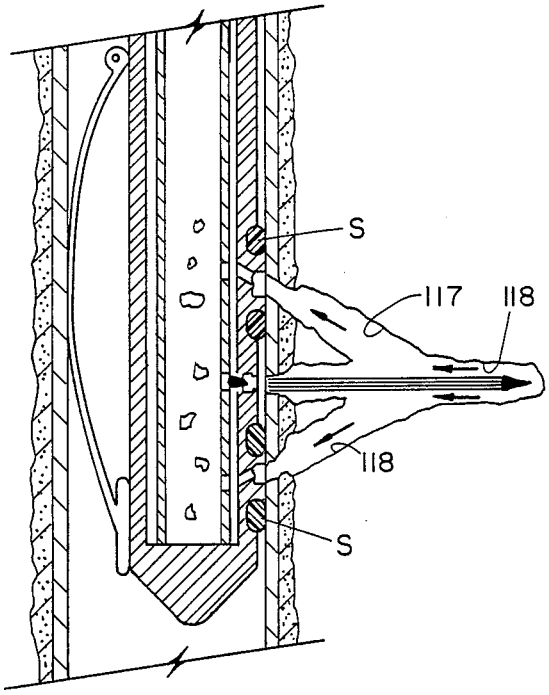

Referring now to FIG. 11, the location of the seals S is changed relative to the converging perforations 117, 118 so that fluid flow through a horizontal perforation 119 produces a jet which returns to the tool via the angular perforations 117 and 118.

Figure 12:
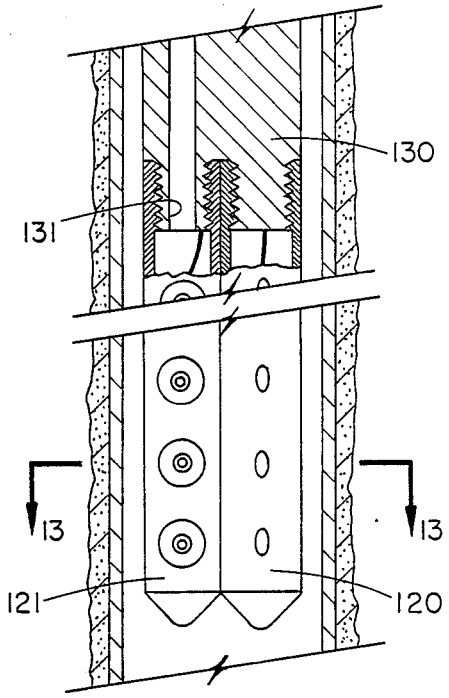
FIG. 12 is a partial view in longitudinal cross-section of an arrangement showing side by side perforator housings.
Figure 13:
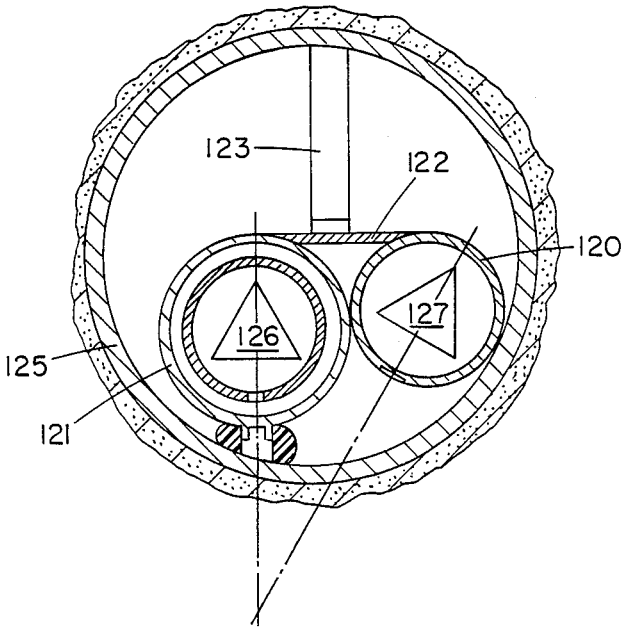
FIG. 13 is a view in cross-section taken along line 13—13 of FIG. 12.

Referring now to FIGS. 12 and 13 a different form of structure is illustrated. In FIGS. 12 and 13, there are side-by-side tubular perforating housings 120, 121 which are connected to one another in a lengthwise direction and attached to lengthwise extending plate member 122. (See FIG. 13). The plate member 122 carries a lengthwise extending spring means 123 for eccentering the housings 120, 121 in a casing 125. One of the housings 121 has exterior seal rings S disposed along its length in alignment with shaped charges 126 arranged to produce a perforating jet in earth formations. The other housing 120 has shaped charges 127 along its length where the shaped charges 127 are in horizontal alignment with corresponding shaped charges 126 in the other housing and are aligned so as to produce an intersecting perforations in a horizontal plane in the earth formations 130. Both housings 120, 121 are connected to a tubular block member 130. The block member 130 has an opening 131 which is in fluid communication with the bore of a string of tubing. The firing head (not shown) for the shaped charges is as described in FIG. 5. When the shaped charges are detonated, intersecting perforations are produced so that liquid in the casing 125 can be jetted through one of the perforations and returned through the other perforation to the string of tubing. It will be appreciated that with this configuration, closures as in FIGS. 7 and 8 are not necessary.

Figure 14:
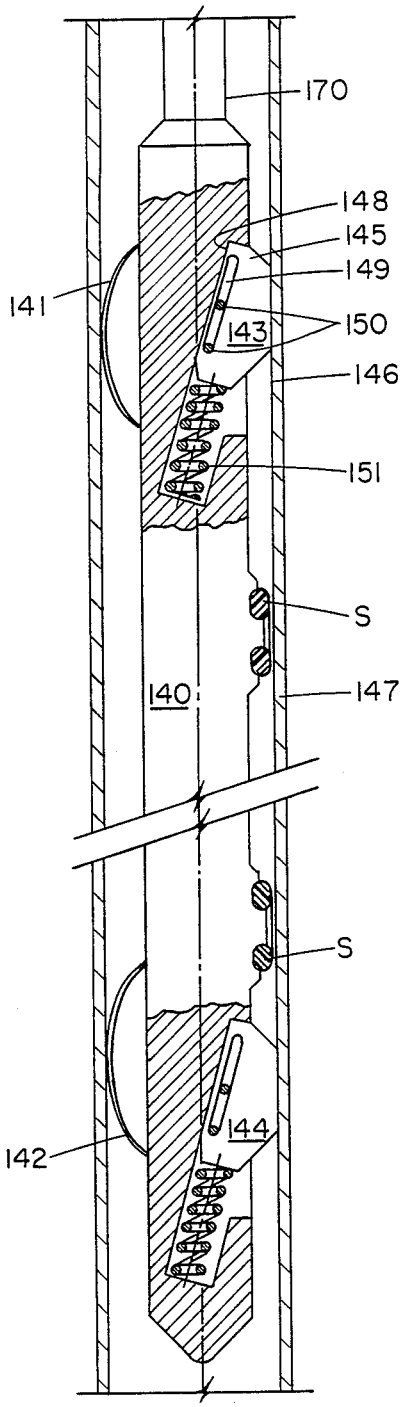
FIG. 14 is a view of a tool with spacer blocks for protecting sealing rings while going in the casing.
Figure 15:
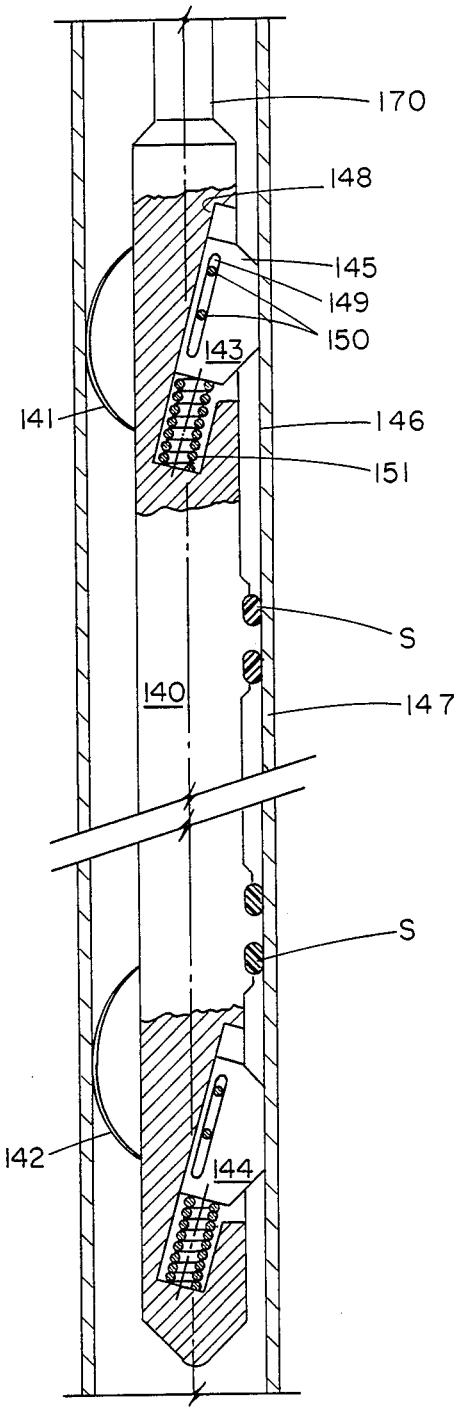
FIG. 15 is a view of a tool similar to FIG. 14 but with the spacer block retracted and the sealing rings in contact with a well casing.

Referring now to FIG. 14 and FIG. 15, a form of apparatus is illustrated for protecting the seal members from abrasion while going in the hole.

In FIGS. 14 and 15, a single tool housing 140 is provided with spaced apart, upper and lower eccentering means 141, 142. Diametrically opposite to the eccentering means 141, 142 are upper and lower stand-off members 143, 144. A stand-off member 143 or 144 includes a lengthwise extending block member 145 with a forward surface 146 normally arranged to be parallel to the length of the casing 147. The block member 145 has a rearward surface 148 which is inclined relative to the forward surface 146 and arranged to slide along an inclined surface in the tool body. A slot 149 in a block member is arranged parallel to the surface 148 and a pair of pins 150 provides guide means for a block member. A spring 151 in the tool housing 140 normally urges a block member upwardly and outwardly of the tool body to engage the wall of the well casing. Thus, in the position shown in FIG. 14, while going in the well bore, the block members 143, 144 space the sealing members 5 from the wall of the casing.

When the tool is in position for operation, an upward pull on the string of tubing 170 causes the block members 143, 144 to retract downwardly and into the tool housing and compress the spring 151 while the eccentering means 141, 142 pushes the sealing means S into sealing contact with the casing 147.

It will be appreciated that the present invention is concerned particularly with consolidated sands where the effects of shaped charge damage are more evident.

It will be apparent to those skilled in the art that various changes may be made in the invention without departing from the spirit and scope thereof and therefore the invention is not limited by that which is enclosed in the drawings and specifications but only as indicated in the appended claims.

I claim:

1. A perforating apparatus for perforating earth formations traversed by a casing which is cemented in a well bore comprising:

(a) an elongated tubular housing having a closed interior bore which is open at one end and adapted for coupling and for fluid communication with a string of tubing when disposed in a casing adjacent to earth formations, (b) a set of first and second shaped charge perforating devices disposed in said closed interior bore and aligned relative to one another so as to produce, when detonated, first and second perforation openings in the tubular housing and intersecting first and second perforations in earth formations behind a casing where the first and second perforations extend into the earth formations from first and second entrance openings in a casing, (c) means for isolating a first perforation opening produced in said tubular housing upon detonation of said first perforating device for preventing fluid from communicating with the closed interior bore of said tubular housing from a first perforation opening when the first perforating device is detonated, (d) seal means on said tubular housing aligned with said second shaped charge perforating device for providing a seal between the tubular housing and a casing and for placing the second perforation opening in fluid communication with a second entrance opening in a casing when the second perforating device is detonated so that fluid may be comunicated from the closed interior bore to the second perforation opening, (e) means for urging said tubular housing against a casing for engaging said seal means in a sealing relationship to a casing, and (f) means for detonating said perforating devices for producing intersecting first and second perforations when said perforating apparatus is disposed in a casing so that a first perforation is in fluid communication with the casing and a second intersecting perforation is in fluid communication with the closed interior bore of said tubular housing.

2. Apparatus as set forth in claim 1 and further including:

(a) a tubular enclosure member in said tubular housing for supporting and for containing said shaped charge devices.

3. Apparatus as set forth in claim 1 and further including a pressure response valve means in said tubular housing, said valve means being responsive to a pressure differential for placing said tubular housing in fluid communication with a string of tubing.

4. Apparatus as set forth in claim 1 wherein said first and second perforations are disposed in a generally vertical plane.

5. A perforating apparatus for perforating earth formations traversed by a casing which is cemented in a well bore comprising:

(a) an elongated tubular housing having a closed interior bore which is open at one end and adapted for coupling and for fluid communication with a string of tubing when disposed in a casing adjacent to earth formations, (b) a set of first, second and third shaped charge perforating devices disposed in said closed interior bore and aligned relative to one another so as to produce, when detonated, first, second and third perforation openings in the tubular housing and intersecting first, second and third perforations in earth formations behind a casing where the first, second and third perforations extend into the earth formations from first, second and third entrance openings in a casing, (c) means for isolating at least one perforation opening produced in said tubular housing upon detonation of a perforating device for preventing fluid from communicating with the closed interior bore of said tubular housing from at least one perforation opening when the perforating device is detonated, (d) seal means on said tubular housing aligned with at least one shaped charge perforating device for providing a seal between the tubular housing and a casing and for placing at least one perforation opening in fluid communication with at least one entrance opening in a casing when a perforating device is detonated so that fluid may be communicated from the closed interior bore to at least one perforation opening, (e) means for urging said tubular housing against a casing for engaging said seal means in a sealing relationship to a casing, and (f) means for detonating said perforating devices for producing intersecting first, second and third perforations when said perforating apparatus is disposed in a casing so that at least one of said perforations is in fluid communication with the casing and at least one of said intersecting perforations is in fluid communication with the closed interior bore of said tubular housing.

6. The apparatus as set forth in claim 5 wherein said first, second and third shaped charge perforating devices are aligned in a vertical direction and said first and third devices are angularly disposed so as to produce converging perforations with respect to a horizontal perforation produced by said second shaped charge perforating device.

7. The apparatus as set forth in claim 6 wherein seal means are aligned with said first and third shaped charge perforating device.

8. The apparatus as set forth in claim 6 wherein said seal means are aligned with said second shaped charge perforating device.

9. A perforating apparatus for perforating earth formations traversed by a casing which is cemented in a well bore comprising:

(a) an elongated tubular housing means including a closed interior bore which is open at one end and adapted for coupling and for fluid communication with a string of tubing when disposed in a casing adjacent to earth formations, (b) a set of first and second shaped charge perforating devices disposed in said housing means and aligned relative to one another so as to produce, when detonated, first and second perforation openings in the housing means and intersecting first and second perforations in earth formations behind a casing where the first and second perforations extend into the earth formations from first and second entrance openings in a casing, (c) means for preventing said first perforating device upon operation, from communicating fluid to the closed interior bore of said tubular housing means from the first perforation opening when the first perforating device is detonated, (d) means for placing said second shaped charge perforating device in said housing means in fluid communication with the closed interior bore of said tubular housing means, (e) seal means on said tubular housing means aligned with said second shaped charge perforating device for providing a seal between the housing means and a casing and for placing the second perforation opening in fluid communication with a second entrance opening in a casing when the second perforating device is detonated so that fluid may be communicated between the closed interior bore and the second perforation opening, (f) means for urging said housing means against a casing for engaging said seal means in a sealing relationship to a casing, (g) means for detonating said perforating devices for producing intersecting first and second perforations when said perforating apparatus is disposed in a casing so that a first perforation is in fluid communication with the casing and a second intersecting perforation is in fluid communication with the closed interior bore of said tubular housing means.

10. Apparatus as set forth in claim 9 wherein said first and second perforations are developed in a horizontal plane.

11. The apparatus as set forth in claim 10 wherein said housing means includes tubular housing members respectively for said first and second shaped charge perforating devices.

12. A perforating apparatus for perforating earth formation traversed by a casing which is cemented in a well bore comprising:

(a) an elongated housing member adapted for coupling to a string of tubing and having spaced apart sealing members disposed along its length and in vertical alignment, (b) eccentering means disposed in vertical alignment on said housing member and arranged so as to urge said sealing members into sealing engagement with the wall of a casing, (c) spacer means for spacing said sealing members from the wall of a casing while going in the casing with the well tool, said spacer means including spacing members and means for resiliently moving said spacing members to a first position for engagement with a well casing where said sealing members are spaced from contact with a well casing, and means for permitting retraction of said spacing members relative to said housing member for urging said sealing members into contact with a well casing; and said housing member and said spacing members havin complimentarily inclined and sliding surfaces.

13. The apparatus as set forth in claim 12 wherein said housing member and said spacing member have cooperating pin and slot means for limiting relative movement.

14. A method of forming perforations in earth formations traversed by a casing cemented in a well bore and containing fluid comprising the steps of:

(a) disposing a perforating gun on a string of tubing extending from the earths surface to a downhole location where perforation of earth formations is desired and where the perforating gun includes:

(1) an elongated tubular housing having a closed interior bore in fluid communication with the string of tubing, (2) a set of first and second shaped charge perforating devices disposed in said closed interior bore and aligned relative to one another so as to produce, when detonated, first and second perforation openings in the tubular housing and intersecting first and second perforations in earth formations behind a casing where the first and second perforations extend into the earth formations from first and second entrance openings in a casing, (3) means for isolating a first perforation opening produced in said tubular housing upon detonation of said first perforating device for preventing fluid from communicating with the closed interior bore of said tubular housing from the firt perforation opening when the first perforating device is detonated, (4) seal means on said tubular housing aligned with a second shaped charge perforating device for providing a seal between the tubular housing and a casing and for placing the second perforation opening in fluid communication with a second entrance opening in a casing when the second perforating device is detonated so that fluid may be communicated from the closed interior bore to the second perforation opening, and (5) means for urging said tubular housing against a casing for engaging said seal means in a sealing relationship to a casing, (b) detonating said perforating devices for producing intersecting first and second perforations where a first perforation is unsealed and in fluid communication with the casing and a second intersecting perforation is sealed and in fluid communication with the closed interior bore of said tubular housing, (c) applying differential pressure between the fluid in the casing and the inside of the tubing for passing fluid through the unsealed perforation for developing a hydraulic jet action where the return flow for the fluid is to the sealed perforation and to the string of tubing.

15. The method as set forth in claim 14 and further including the step of closing off the string of tubing and supplying fluid under pressure in the casing to the earth formations for injecting fluid into said perforations.

16. The method as set forth in claim 14 and further including the step of removing the pressure on the fluid in the casing and tubing and producing fluids from the earth formations.

17. A method of cleaning intersecting perforations in earth formations traversed by a well bore comprising the steps of:

(a) coupling a source of fluid at the earths surface to an in-place perforation in an earth formation via the bore of a casing where the in-place perforation is in fluid communication with another intersecting perforation which opens to the well casing, (b) coupling the intersecting perforation to a string of tubing which extends to the earth's surface for receiving fluid in the string of tubing passed through the perforations from the casing, and (c) controlling the pressure in the string of tubing relative to the pressure in the casing with a valve means in the string of tubing.

18. A method of cleaning perforations in a well as set forth in claim 17 and further comprising the steps of:

(a) controlling the pressure in the string of tubing relative to the pressure in the casing by running the string of tubing at a low pressure.

19. A method of cleaning perforations as set forth in claim 17 and further comprising the steps of utilizing an abrasive laden fluid and circulating such abrasive laden fluids from the well bore after cleaning the perforations.

* * * * *